US008973642B2

(12) United States Patent
Lawson

(10) Patent No.: US 8,973,642 B2
(45) Date of Patent: Mar. 10, 2015

(54) DISPLAY STANDS

(76) Inventor: Richard John Lawson, Ellastone (GB)

( * ) Notice: Subject to any disclaimer, the term of this patent is extended or adjusted under 35 U.S.C. 154(b) by 10 days.

(21) Appl. No.: 13/147,799

(22) PCT Filed: Feb. 4, 2010

(86) PCT No.: PCT/GB2010/000210

§ 371 (c)(1),
(2), (4) Date: Aug. 3, 2011

(87) PCT Pub. No.: WO2010/089563

PCT Pub. Date: Aug. 12, 2010

(65) Prior Publication Data

US 2011/0290958 A1 Dec. 1, 2011

(30) Foreign Application Priority Data

Feb. 7, 2009 (GB) ..... 0902087.6

(51) Int. Cl.
*A47G 5/00* (2006.01)
*E04H 1/12* (2006.01)
*G09F 15/00* (2006.01)

(52) U.S. Cl.
CPC ..... *E04H 1/1272* (2013.01); *G09F 15/0006* (2013.01); *G09F 15/0018* (2013.01); *G09F 15/0056* (2013.01); *G09F 15/0068* (2013.01)
USPC ..... 160/135; 160/351

(58) Field of Classification Search
USPC ..... 248/683; 52/245, 239, 236.2, 63, 222, 52/780, 781; 160/135, 351, 352; 40/606.12, 606.16
See application file for complete search history.

(56) References Cited

U.S. PATENT DOCUMENTS

| | | | | | |
|---|---|---|---|---|---|
| 354,450 | A | * | 12/1886 | Tripp | 160/327 |
| 684,130 | A | * | 10/1901 | Taubert | 160/84.09 |
| 1,222,805 | A | * | 4/1917 | Schmid | 211/2 |
| 3,428,108 | A | * | 2/1969 | Singer | 160/135 |
| 3,841,042 | A | * | 10/1974 | Siegal | 52/239 |
| 3,889,736 | A | * | 6/1975 | Firks | 160/135 |
| 4,200,254 | A | * | 4/1980 | Nelson | 248/188.8 |
| 4,926,892 | A | * | 5/1990 | Osmonson et al. | 135/140 |
| 5,287,909 | A | * | 2/1994 | King et al. | 160/135 |
| 5,722,477 | A | * | 3/1998 | Richter et al. | 160/135 |
| 5,826,397 | A | | 10/1998 | Armold | |
| 5,836,038 | A | * | 11/1998 | Thorp | 15/209.1 |
| 5,881,789 | A | * | 3/1999 | Melashenko et al. | 160/135 |
| 6,052,958 | A | * | 4/2000 | Miedema et al. | 52/284 |
| 6,226,931 | B1 | * | 5/2001 | Haversat | 52/71 |
| 6,619,008 | B1 | * | 9/2003 | Shivak et al. | 52/282.1 |
| 7,584,776 | B2 | * | 9/2009 | Hardt, II | 160/135 |

(Continued)

OTHER PUBLICATIONS

Alff, Robert, International Search Report for PCT/GB2010/000210, Jun. 29, 2010.

*Primary Examiner* — Alfred J Wujciak
(74) *Attorney, Agent, or Firm* — Chernoff, Vilhauer, McClung & Stenzel LLP

(57) ABSTRACT

A display assembly 10 in the form of at least two interconnected display stands 12A, 12B. Each of the stands 12 includes a spaced pair of vertically extending support members 14 mounted on feet 16. A flexible display member 18 extends between the support members 14 and is held taut thereby. A support arrangement 20 in the form of five pivotally interconnected link members 36, extends between the support members 14 immediately above the feet 16. For adjacent display stands 12, a common support member 14 forms part of each display stand 12.

19 Claims, 3 Drawing Sheets

(56) References Cited

U.S. PATENT DOCUMENTS

2005/0034409 A1 2/2005 Fritsche
2007/0107853 A1* 5/2007 Hsieh ..... 160/135
2010/0133395 A1 6/2010 Durello

* cited by examiner

DISPLAY STANDS

This invention concerns display stands, and also display assemblies.

Display stands are widely used at exhibitions and elsewhere. It is generally required that these can be readily erected and dismantled when required. Such stands often include a flexible display member and a dismountable support arrangement. The display member may be provided on a roller, with a pole or other arrangement locatable in position to retain the display member in position extending from the roller. Other arrangements include a flexible display member removably mountable on a collapsible frame.

It is often required or at least desirable to have the stands in a different shape or alignment, dependent on the space available. It is however generally not possible to curve display stands of the types outlined above. Therefore a curved shape can only be approximately obtained by the relative inclination of adjacent straight display stands.

According to the present invention there is provided a display stand, the stand including a pair of upstanding parallel support members, a flexible display member made of sheet material which extends between the support members and is held taut thereby, and a support arrangement which extends between the support members at or towards the lower end thereof, the support arrangement including a plurality of elongate link members extending in a line between the support members, with the link members pivotally interconnected at respective ends about a substantially vertical axis.

The support arrangement may be configured so as to substantially only permit the support members to move relative to each other in a substantially horizontal plane.

The support members may be formed from lengths of an extrusion, which may be of aluminium.

The support members may be generally rectangular, and desirably generally square, in plan view, and may permit mounting of a display member and/or support arrangement to any of the four sides thereof.

The link members may have a first connection structure at one end and a second connection structure at the other end, with respective first and second connection structures engageable together to pivotally connect adjacent link members.

The link members may have a sprung interconnection such that they are spring urged to a linear alignment.

The first and/or second connection structures may be configured to be substantially rigidly mountable to a support member.

One or more recesses may be provided in each support member to receive a first and/or second connection structure. A recess may be provided on each side of the support member.

A ground engaging foot member may be provided for each support member. An engagement arrangement may be provided for selectively retaining a support member on a foot member.

Each engagement arrangement may include a part on the support member selectively movable between a position engaging a formation on a foot member and a disengaged position.

The formation may be elongate and may comprise a channel, such that the relative mounting position of the support member or the foot member can be varied.

A plurality of formations may be provided on the foot member such that the support member can be mounted to a respective one thereof as required.

The display member is preferably attached to the support members by one or more magnets on the rear of the display member. The magnets may be in the form of a magnetic tape.

The invention also provides a display assembly, the assembly comprising two or more display stands according to any of the preceding twelve paragraphs, with adjacent display stands sharing a common upstanding support member therebetween.

An embodiment of the present invention will now be described by way of example only and with reference to the accompanying drawings, in which:—

Figure 1:
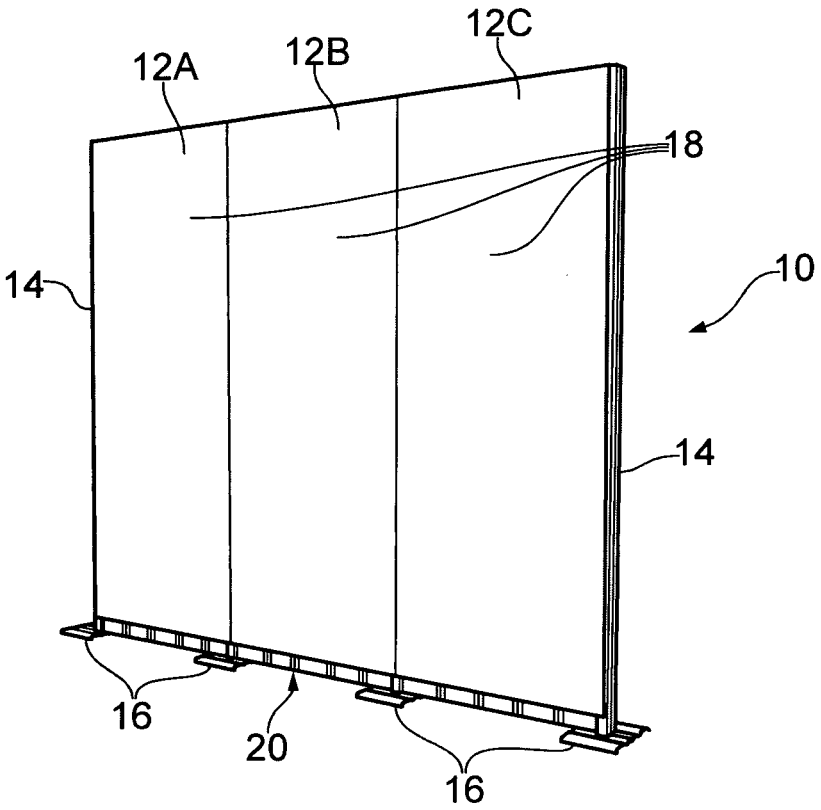
FIG. 1 is a perspective view of a display assembly according to the invention in a straight configuration.

The drawings show a display assembly 10 in the form of three interconnected display stands 12A, 12B, 12C. Each of the stands 12 includes a spaced pair of vertically extending support members 14 mounted on feet 16. A flexible display member 18 extends between the support members 14 and is held taut thereby. A support arrangement 20 extends between the support members 14 immediately above the feet 16. For adjacent display stands 12, a common support member 14 forms part of each display stand 12.

The support members 14 are in the form of lengths of an aluminium generally square extrusion 22. The extrusion 22 has a central square part 24 with a further square part 26 extending from each corner of the square part 24. A recess 28 is defined between each pair of further square parts 26, and lips 30 extend from each further square part 26 to define a narrower opening 32 to each recess 28. A lip 34 extends from the outer corner of each further square part 26.

The display members 18 are mounted on the support members 14, by magnetic tape provided along side edges of the display members 18 on the rear side thereof. The magnetic tape will locate on the outside of the respective further square part 26, and engage against the respective lip 34 to provide an accurate location of the display members 18.

Each support arrangement 20 comprises five link members 36 extending in a line between the respective support members 14. Each link member 36 includes a first connection arrangement 38 at one end and a second connection arrangement 40 at the other end. The first connection arrangement includes a part circular formation 42 from which extends an outwardly curved arcuate section 44, with a smaller part circular formation 46 extending via a web 48 from the arcuate section 44.

Figures 3, 4, 5, 6, 7:
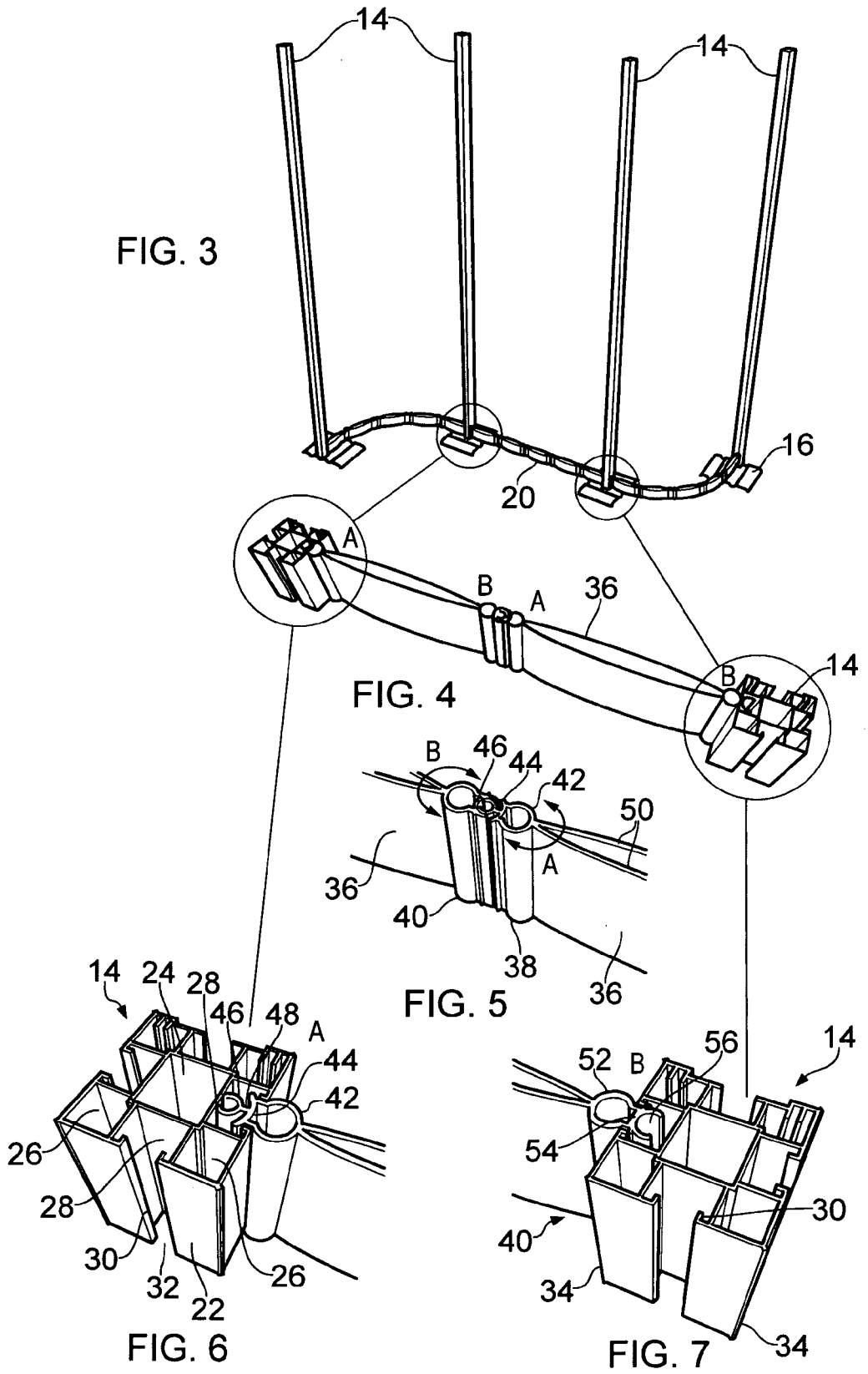
FIG. 3 is a similar view to FIG. 2 but with part of the assembly removed.
FIG. 4 is a diagrammatic view of some of the components of the assembly of FIG. 1 in an illustrative configuration.
FIGS. 5 to 7 are respectively more detailed perspective views of parts of FIG. 4.

When mounted to a support member 14 as shown in FIG. 6 the arcuate section 44 is of a size to locate within a one of the recesses 28 but be retained in there by the lips 30, with the smaller part circular formation 46 engageable against the square part 24 to substantially prevent pivoting of the respective link member 36 relative to the support member 14.

From the first connection arrangement 38 the link 36 extends in the form of a pair of gently convex plates 50 to the second connection arrangement 40. The second connection arrangement 40 has a part circular formation 52 similar to the part circular formation 42. The part circular formation 52 has a web 54 extending across an open part thereof. The web 54 mounts a further part circular formation 56 which is smaller than the part circular formation 52 but larger than the part circular formation 46.

As can be seen from FIG. 7, the web 54 is of a size to provide a substantially rigid mounting across the opening 32 of a one of the recesses 28 with the part circular formation 56 extending into the respective recess 28. This provides a substantially rigid mounting between the second connection arrangement 40 and a respective support member 14.

Adjacent link members 36 are interconnected by the smaller circular part formation 46 of the first connection arrangement 38 locating in the part circular formation 56 of the second connection arrangement 40. This permits relative pivoting about a substantially vertical axis. A fastener (not shown) may be provided to prevent relative vertical movement between the link members 36.

The feet 16 are in the form of profiled members 58 with downwardly turned sides 60 which are ground engaging. Grooves 62 are also provided in the members 58, spaced from the sides 60, and which are ground engaging. A pair of channels 64 are provided, one extending substantially centrally across the feet 16 parallel to the grooves 62, and the other a side channel extending parallel to the central channel 64, but between a one of the grooves 62 and the respective side 60.

Figure 8:
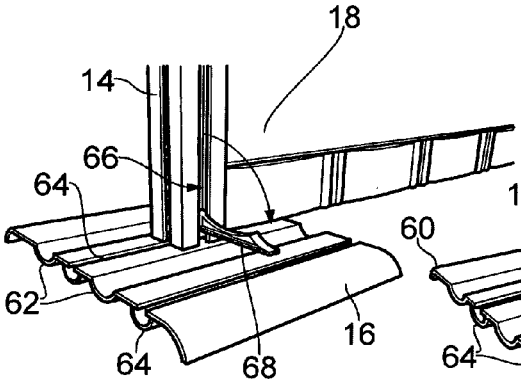
FIG. 8 is a diagrammatic view of part of the assembly of FIG. 1 in a first condition.

An engagement arrangement 66 is provided mounted at the base of the support members 14 in a side one of the recesses 28. The engagement arrangement 66 includes an engagement member (not shown) which is selectively movable to engage in a one of the channels 64 by a cam arrangement connected to a handle 68. When the handle 68 extends horizontally as shown in FIG. 8 the member is disengaged from the respective channel 64, but when the handle 68 locates in the respective recess 28 the engagement member is engaged in the respective channel 64 to mount the support member 14 on the foot 16.

Figure 9:
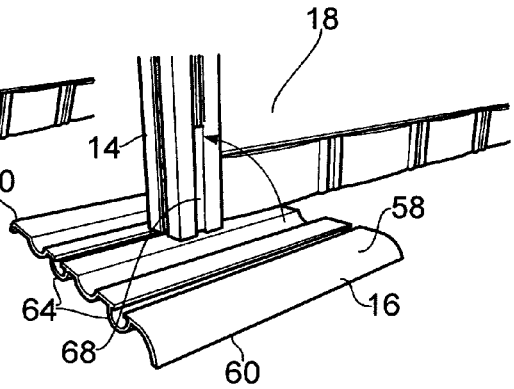
FIG. 9 is similar to FIG. 8 but in a second condition.

As the channels 64 are elongate, the support members 14 can be mounted in a required position thereon. For instance where the support member mounts a display member on each side, the support member 14 will usually be provided generally centrally on the foot 16 as shown in FIGS. 8 and 9, and also in the central parts of FIG. 10.

Figure 10:
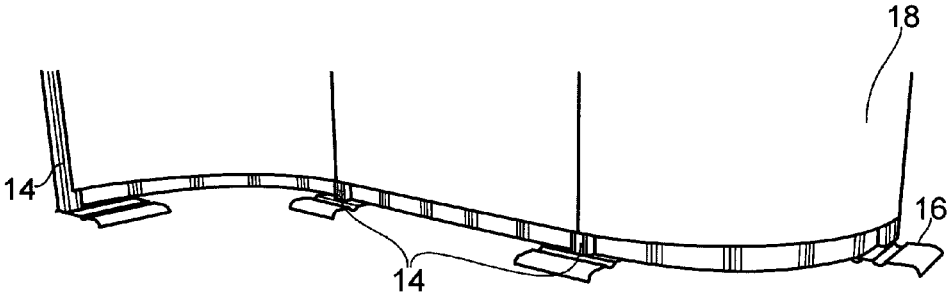
FIG. 10 is a diagrammatic perspective view of a lower part of the assembly as shown in FIG. 2.
Figure 11:
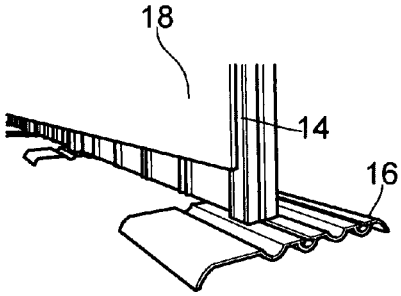
FIGS. 11 and 12 are views of a lower part of the assembly of FIG. 1 in different configurations.
Figure 12:
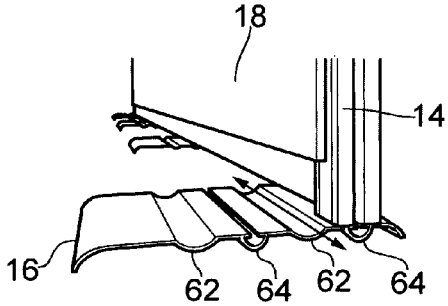

At the end of the display assembly 10 where there is only a display member 18 on one side, the support member 14 can be mounted substantially at the end of a foot 16 as shown at each end in FIG. 10, and also in FIG. 12. This can be significant if abutting against a wall extending transversely to the assembly 10. If the assembly 10 is positioned generally parallel to a wall, then the support members 14 can be mounted in the side channel 64 to bring the display members 18 closer to the wall as shown in FIGS. 11 and 12.

Figure 2:
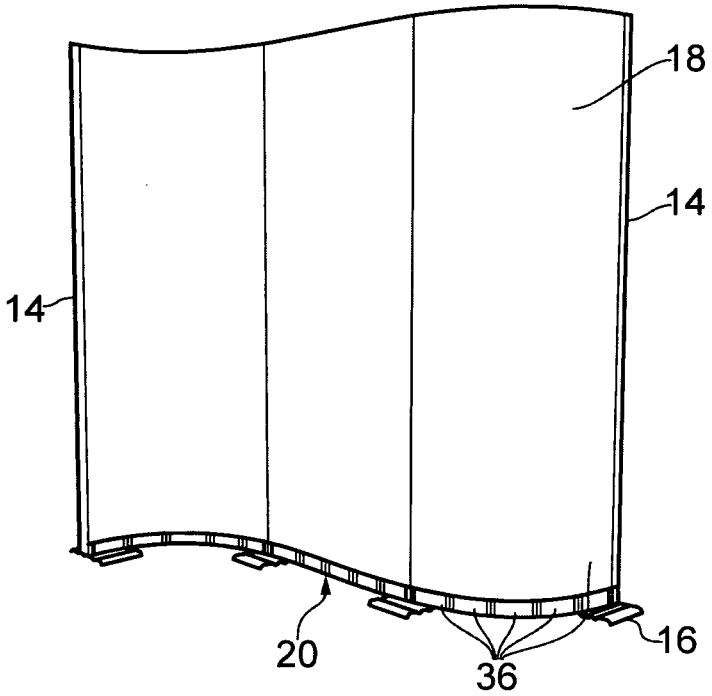
FIG. 2 is a similar view to FIG. 1 but with the display assembly in a curved configuration.

The support arrangements 20 permit the display assembly to adapt a wide range of different curved profiles, as illustrated for instance in FIG. 2, with a generally straight central display member 18, and display members 18 on either side, curved in opposite directions. Obviously a wide range of different shapes can be chosen as desired, with a required number of display stands 12.

The support arrangement 20 substantially only prevents relative movement of the support members 14 in a horizontal plane whilst maintaining a constant spacing between the support members 14. This will mean for instance that the tops of the support members 14 are substantially prevented from moving front to back or side to side relative to the support arrangement 20. The configuration of the support members 14 mean that more than two display members 18 could be mounted thereto, or display members could be mounted perpendicularly to each other.

There is thus described a display assembly which permits a wide range of shapes to be adopted whilst maintaining the integrity and tautness of the display members 18, and thus the appearance of the assembly. The assembly whilst permitting a wide range of possibilities could still be readily erected and dismantled as required. The arrangement of the feet permits appropriate mounting relative to surrounding walls or other fixtures or to avoid trip hazards.

It is to be realised that a number of modifications may be made without departing from the scope of the invention. The number of adjacent display stands provided can be chosen as required, as can the types of the display stands. A different number of link members could be provided. The link members may have a sprung interconnection so as to be urged to a linear alignment. The support members may have a different form, and different connection arrangements could be used. Different feet and/or engagement arrangements therewith, could be used.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A display stand, the stand including a pair of upstanding parallel support members, one, and only one, flexible display member made of sheet material which extends between the support members and is held taut thereby, the flexible display member including two opposite edges, each edge being mounted to a respective upstanding parallel support member, and a support arrangement which extends between the support members at or towards the lower end thereof, the support arrangement including a plurality of elongate link members extending in a line between the support members, with the link members rigidly mounted to the support members and pivotally interconnected to one another each about a respective substantially vertical axis, the flexible display member being flexible about each respective substantially vertical axis, the link members each having a first connection structure at one end and a second connection structure at the other end, with respective first and second connection structures engageable together to pivotally connect adjacent link members, wherein the first and/or second connection structures are configured to be substantially rigidly mountable to the support member.

2. A display stand according to claim 1, in which the support arrangement is configured so as to substantially only permit the support members to move relative to each other in a substantially horizontal plane.

3. A display stand according to claim 1, in which the support members are formed from lengths of an extrusion.

4. A display stand according to claim 3, in which the support members are formed from aluminium.

5. A display stand according to claim 1, in which the support members are generally rectangular in plan view.

6. A display stand according to claim 1, in which the support members are generally square in plan view.

7. A display stand according to claim 5, in which the support members permit mounting of a display member and/or support arrangement to any of the four sides thereof.

8. A display stand according to claim 1, in which the link members have a sprung interconnection such that they are spring urged to a linear alignment.

9. A display stand according to claim 1, in which one or more recesses are provided in each support member to receive a first and/or second connection structure.

10. A display stand according to claim 9, in which a recess is provided on each side of the support member.

11. A display stand according to claim 1, in which a ground engaging foot member is provided for each support member.

12. A display stand according to claim 11, in which an engagement arrangement is provided for selectively retaining the support member on the foot member.

13. A display stand according to claim 12, in which each engagement arrangement includes a part on the support member selectively movable between a position engaging a formation on the foot member and a disengaged position.

14. A display stand according to claim 13, in which the formation is elongate.

15. A display stand according to claim 14, in which the formation comprises a channel, such that the relative mounting position of the support member or the foot member can be varied.

16. A display stand according to claim 13, in which a plurality of formations is provided on the foot member such that the support member can be mounted to a respective one thereof as required.

17. A display stand according to claim 1, in which the display member is attached to the support members by one or more magnets on the rear of the display member.

18. A display stand according to claim 17, in which the magnets are in the form of a magnetic tape.

19. A display assembly, the assembly comprising two or more display stands according to claim 1, with adjacent display stands sharing the common upstanding support member therebetween.

* * * * *